US008403458B2

(12) United States Patent
Montfort et al.

(10) Patent No.: US 8,403,458 B2
(45) Date of Patent: Mar. 26, 2013

(54) LATCHING ASSEMBLY FOR A PRINTHEAD

(75) Inventors: David B. Montfort, Webster, NY (US); Matthew D. Savoy, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 168 days.

(21) Appl. No.: 13/102,412

(22) Filed: May 6, 2011

(65) Prior Publication Data

US 2012/0281045 A1 Nov. 8, 2012

(51) Int. Cl.
*B41J 2/14* (2006.01)
*B41J 2/16* (2006.01)

(52) U.S. Cl. ..... 347/40

(58) Field of Classification Search ..... 347/49
See application file for complete search history.

(56) References Cited

U.S. PATENT DOCUMENTS

| | | | | |
|---|---|---|---|---|
| 3,656,466 | A | 4/1972 | Dzus, Jr. | |
| 3,874,041 | A | 4/1975 | Smith | |
| 4,047,266 | A | 9/1977 | Bisbing | |
| 4,293,984 | A | 10/1981 | Kaufmann, Jr. | |
| 4,498,827 | A | 2/1985 | Mair | |
| 4,705,442 | A | 11/1987 | Fucci | |
| 5,690,460 | A | 11/1997 | Attanasio | |
| 5,700,122 | A | 12/1997 | Karpi | |
| 5,865,582 | A | 2/1999 | Ellis et al. | |
| 6,568,893 | B2 | 5/2003 | LeVey et al. | |
| 6,575,682 | B1 | 6/2003 | Dohm et al. | |
| 6,612,795 | B2 | 9/2003 | Kirchen | |
| 7,077,501 | B2 * | 7/2006 | Kitahara et al. | 347/40 |
| 7,173,685 | B2 | 2/2007 | Van Den Wildenberg | |
| 7,241,264 | B2 | 7/2007 | Xiao et al. | |
| 7,491,025 | B2 | 2/2009 | Tangeman et al. | |
| 7,537,409 | B2 | 5/2009 | Huhnerbein | |
| 7,578,578 | B2 * | 8/2009 | Akahane | 347/49 |
| 7,874,779 | B2 | 1/2011 | Csik et al. | |
| 7,988,396 | B2 | 8/2011 | Weiss et al. | |
| 2001/0038781 | A1 | 11/2001 | Mallet et al. | |
| 2007/0196196 | A1 | 8/2007 | Schorling et al. | |
| 2008/0014779 | A1 | 1/2008 | Lee et al. | |

* cited by examiner

*Primary Examiner* — Matthew Luu
*Assistant Examiner* — Renee I Wilson
(74) *Attorney, Agent, or Firm* — Maginot, Moore & Beck, LLP

(57) ABSTRACT

A latching assembly for mounting a printhead to a plate assembly of a printing machine includes a first elongated actuator and a second elongated actuator defining a bore to slidably receive the first actuator. A first spring is disposed between the heads of the first and second actuators, while a second spring is disposed between the second actuator and the printhead to exert a clamping force. A cam mechanism is defined between the plate assembly and the ends of the actuators that is configured to draw the head of the first actuator toward the plate assembly upon rotation of the first actuator and to independently draw the head of the second actuator toward the plate assembly upon rotation of said second actuator. Movement of said first actuator exerts an initial clamping force while movement of the second actuator produces a final clamping force on the printhead.

11 Claims, 5 Drawing Sheets

LATCHING ASSEMBLY FOR A PRINTHEAD

TECHNICAL FIELD

The present invention relates to image producing or printing machines, and more specifically to the mounting of printheads in such machines.

BACKGROUND

Referring to FIG. 1, a printhead assembly 230 for a high-speed or high throughput, multicolor image producing or printing machine is shown. The assembly 230 is coupled to a controller 200 configured to control the operation of the printhead assembly and more particularly to direct the printheads of the assembly to produce an image from captured image data. For certain machines, the controller 200 may also control at least one actuator 220 that is operable to move the printhead relative to the substrate receiving the image. The assembly 230 shown in FIG. 1 includes two printheads 232 and 236, each having a corresponding front face 233, 237 and nozzle array 243, 245 for ejecting ink onto the substrate to form an image. It can be appreciated that an imaging or printing machine may include more than one printhead assembly 230 and more than the two printheads shown in FIG. 1. Although a solid-ink printhead is depicted in the drawings, other printheads and printing or imaging machines are contemplated. In addition, a partial width printhead is shown, but other printheads, including full-width and reciprocating array printheads are contemplated.

Each printhead 232, 236 is rigidly mounted to a carrier plate or ball plate assembly that may itself be rigidly mounted to a translation carriage controlled by the actuator 220. Thus, in a typical installation, the printheads are mounted to the carrier plate assembly by a plurality of fasteners 250. One such arrangement is shown in FIGS. 2-3. The printhead 232 is shown mounted to a carrier plate assembly 260 in FIG. 2 by a screw-type fastener 250. As shown in more detail in FIG. 3, the fastener 250 includes a shank 252 terminating in a threaded tip 254 configured to thread into an internally threaded boss 262. The head 256 of the fastener may incorporate a hex-feature for engagement with a driving tool to rotate the fastener/screw 250. A spring 258 is mounted between an enlarged portion 257 of the head 256 and a mounting flange 239 of the printhead. A snap-ring 259 may be used to capture the fastener on the mounting flange 239. As the fastener is tightened into the threaded boss 262 of the carrier plate assembly 260 the spring bears against the mounting flange 239 to press the printhead 232 against a surface 264 (FIG. 4) of the carrier plate assembly to form a fluid-tight seal.

It is important that the printhead be properly engaged with the carrier plate assembly or ball plate to provide a fluid-tight engagement and to ensure that the printhead is correctly registered with the image-receiving substrate. When the printheads are replaced, care must be taken that the fasteners 250 are adequately and properly tightened to produce this proper engagement. Thus, in one procedure, each printhead 232, 236 is mounted using two fasteners 250, as shown in FIG. 1. To ensure proper seating of the printhead, the fasteners or screws 250 are tightened in alternating fashion until each screw is seated. The mating threads 254 typically have a fine pitch so multiple rotations of each fastener 250 is required to fully tighten each screw and seat the printhead. In order to ensure proper seating, the installation procedure typically requires making two full turns on one fastener, two full turns of the other fastener, and then repeating this sequence a second time to seat the printhead.

It can be appreciated that engaging the head 256 of each fastener in alternating fashion with a driving tool can be cumbersome and time consuming. Since the typical procedure requires a precise number of screw rotations for each step, it is not well-suited for use of a power driving tool. Thus, the driving tool must be a manual tool, such as a hex wrench, which can lead to user fatigue when replacing several printheads at one time, as frequently occurs. Moreover, unless a torque wrench is used there is always the risk that a customer will over-tighten a fastener which can lead to stripping of the threads or even fracture of the boss 262. It is desirable to provide a mechanism for mounting printheads to carrier plate or ball plate assemblies that is easier and more convenient to operate.

SUMMARY

In one aspect, a latching assembly for mounting a printhead to a plate assembly of a printing machine, in which the printhead and the plate assembly have coaxial openings, comprises a first elongated actuator having a first head end and an opposite first cam end, and a second elongated actuator configured to extend through the coaxial openings in the printhead and the plate assembly, the second actuator having a second head end and an opposite second cam end, and defining a bore configured to slidably receive the first elongated actuator therethrough. In a further aspect, the latching assembly includes a first force transmission element disposed between the first head end and the second head end, a second force transmission element disposed between the second head end and the printhead, and a cam mechanism defined between the plate assembly and the first cam end and the second cam end. In one feature, the cam mechanism is configured to draw the first head end toward the plate assembly upon rotation of the first cam end and to draw the second head end toward the plate assembly upon rotation of the second cam end. Movement of the first head end toward the plate assembly causes the first force transmission element to exert a force on the second head end and movement of the second head end toward the plate assembly causes the second force transmission element to exert a force on the printhead.

DETAILED DESCRIPTION

For a general understanding of the environment for the devices and methods disclosed herein, as well as details thereof, reference is made to the drawings. As used herein, the words "printer", "printing machine" or "imaging machine" encompass any apparatus or machine that performs a print outputting function for any purpose, such as a digital copier, bookmaking machine, facsimile machine, multi-function machine, or the like.

Figure 4:
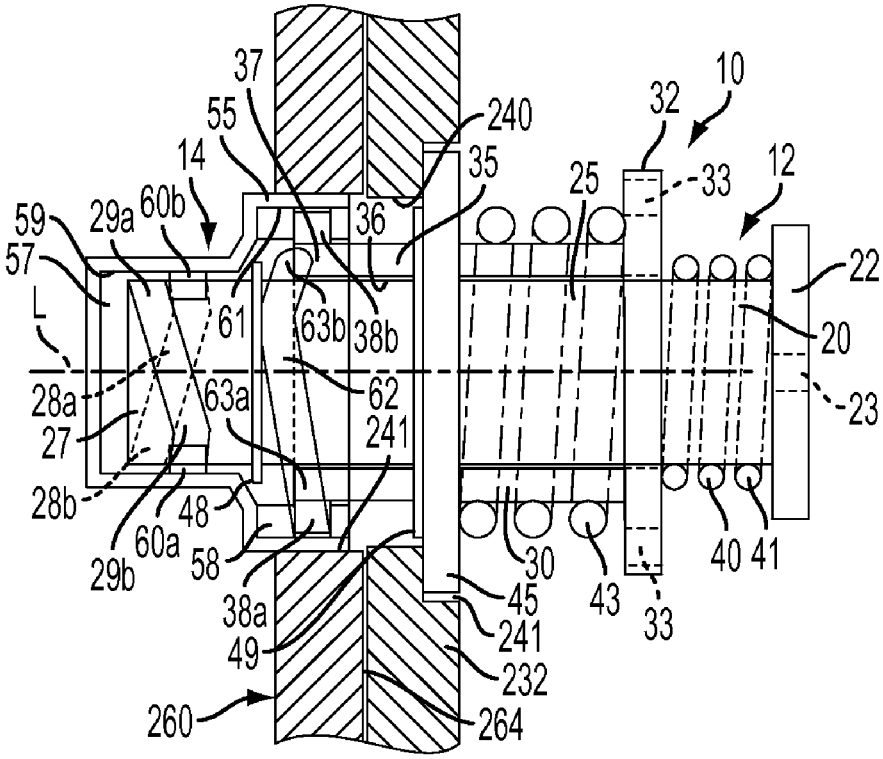
FIG. 4 is a side view of a latching assembly according to a disclosed embodiment used to mount a printhead to a carriage plate assembly.

Referring to FIG. 4, a latch assembly 10 is shown engaged to the printhead 232 and the carriage plate assembly 260 to press the printhead against surface 264 of the plate assembly in a tight, sealed engagement. It is understood that the latch assembly may be mounted on the flange 239 in a manner similar to the prior art latching mechanisms. In the illustrated embodiment, the latch assembly 10 is a generally cylindrical actuator assembly 12 that extends through coaxial openings 240, 241 formed in the printhead and plate assembly, respectively. A cam mechanism 14 is provided between the distal end of the actuator assembly and the carriage plate assembly 260. As described herein, the cam mechanism implements a two-stage operation, with an initial stage that loosely draws the printhead to the plate assembly followed by a second stage in which the two components are tightly clamped together. The cam mechanism 14 is further configured to limit the amount of rotation of the actuator assembly components necessary to tightly clamp the printhead and plate assembly.

The actuator assembly 12 comprises a first stage actuator 20 that includes a head 22 with a tool engagement feature 23 (FIG. 5) and an elongated shaft 25 extending therefrom. The distal end of the shaft forms a cam end 27 that forms part of the cam mechanism 14. In one embodiment, the cam end 27 includes a pair of cam tracks 28 formed around the circumference of the shaft 25. As shown in FIG. 4, the cam tracks are arranged at an angle relative to the longitudinal axis L of the shaft. In the illustrated embodiment, two cam tracks 28*a*, 28*b* are provided that are diametrically offset from each other, although one or more cam tracks are contemplated. Also in the illustrated embodiment the cam tracks span about 90° to permit quarter turn operation of the first stage actuator. However, it is also contemplated that the span of the cam tracks may be modified in relation to the angle of the tracks, as explained in more detail herein. Each cam track includes an entry end 29*a* that intersects the end of the shaft 12 so that a corresponding cam follower can enter the track. Each cam track also includes an inboard retention end 29*b* that is oriented at an angle relative to the rest of the track. In particular, the retention end 29*b* is arranged either perpendicular to the longitudinal axis L or angled slightly toward the distal tip of the cam end 27, as shown in FIG. 4. This orientation holds the cam follower in position as described in more detail herein.

The cam mechanism 14 includes the cam tracks 28*a*, 28*b* described above as well as a like number of cam followers associated with the carriage plate assembly 260. Thus in the illustrated embodiment, a cam receptacle 55 is provided that is configured to be mounted to the plate assembly 260. As shown in FIG. 4, in one embodiment the cam receptacle 55 is engaged within the coaxial bore 241 defined in the plate assembly. The cam receptacle is suitably fixed to the plate assembly to prevent movement of the cam receptacle when the two stage actuator assembly is actuated. The cam receptacle 55 defines a first cavity 57 that is arranged to receive the cam end 27 of the first stage actuator 20. The receptacle further defines a larger second cavity 58 to receive the second stage actuator 30 described below.

The first cavity 57 of the cam receptacle includes a pair of cam followers 60*a*, 60*b* projecting radially inward from the side wall 59 of the first cavity 57. Like the cam tracks 28*a*, 28*b*, the followers are diametrically opposite each other. The followers 60*a*, 60*b* are sized to be slidably received within a corresponding cam track 28*a*, 28*b*, preferably with a close running fit. It should be understood that the cam followers 60*a*, 60*b* cause the first stage actuator 20 to translate relative to the plate assembly 260 along the axis L as the cam tracks 28*a*, 28*b* are rotated relative to the followers. Thus, when the actuator 20 is rotated clockwise the cam tracks advance distally along the cam followers, while a counter-clockwise rotation causes the actuator to back out of the cam receptacle. As indicated above, the cam tracks are configured to limit the rotation of the actuator 20 to a quarter turn, or about 90°. When the actuator has been rotated clockwise to its full extent, the cam followers 60*a*, 60*b* seat within a corresponding retention end 29*a*, 29*b*. The alignment of the retention ends resists the retrograde movement of the actuator that might otherwise occur due to the clamping load exerted by the actuator on the printhead/plate assembly interface. The manner in which this clamping load is exerted will be described below.

As indicated above, the actuator assembly 12 further comprises a second stage actuator 30 that includes a head 32 with a tool engaging feature 33 and an elongated shaft 35 extending therefrom. The elongated shaft 35 defines a central bore 36 through which the shaft 25 of the first stage actuator 20 extends, as depicted in FIG. 4. Like the first actuator, the second stage actuator includes a cam end 37 that forms part of the cam mechanism 14. In the illustrated embodiment, the cam end 37 includes a pair of cam followers 38*a*, 38*b* that are diametrically opposite each other. The cam followers 38*a*, 38*b* may each constitute a lug projecting radially outward from the shaft 35.

The cam followers 38*a*, 38*b* are configured to ride within associated cam tracks 62 defined in the side wall 61 of the second cavity 58 of the cam receptacle 55. (Although only one cam track is shown in FIG. 4, each cam follower is provided with a corresponding cam track.) As with the cam tracks for the first stage, the cam tracks 62 for the second stage are also oriented at an angle relative to the longitudinal axis L. Moreover, the cam tracks in the illustrated embodiment span 90° or a quarter turn. Each cam track includes an entry end 63*a* and a retention end 63*b* that is arranged at a different angle from the primary part of the cam track 62. The retention end 63*b* serves the same function as the retention end 60*b* described above, namely to hold the cam followers 38*a*, 38*b* in position. Thus, in one embodiment the retention end 63*b* may be arranged perpendicular to the axis L or angled slightly away from the cam end 37 of the second stage actuator, as depicted in FIG. 4.

The operation of the second stage actuator 30 is similar to the first stage actuator 20. In particular, rotation of the actuator shaft 35 causes the cam followers 38*a*, 38*b* to rotate and follow the cam tracks 62. As the shaft is rotated clockwise the cam followers advance distally along the cam tracks—i.e., toward the cam receptacle—while a counter-clockwise rotation causes the cam followers, and consequently the second actuator, to back out of the cam receptacle. It is understood that in certain embodiments the rotation and translation of the first and second stage actuators are independent, meaning that rotation of one actuator does not cause any corresponding movement of the other actuator. Thus, the shaft 25 of the first stage actuator has a running fit within the central bore 36 of the second actuator shaft 35. The fit is preferably a close running fit to avoid any unnecessary "slop" in the latch assembly 10.

As thus far described, the cam mechanism 14 of the latch assembly 10 provides a mechanism to independently advance the first and second stage actuators 20, 30 toward the cam receptacle 55, or more importantly the carriage plate assembly 260. In order to serve the function of latching the printhead to the plate assembly, this distal movement or advancement must be translated to a force applied to the printhead 232 to push it into solid contact with the surface 264 of the plate assembly 260. The latch assembly 10 thus further comprises a force transmission element 40 disposed between the heads of the actuators and the printhead. In the illustrated embodiment, the force transmission element 40 includes a first spring 41 disposed between the first actuator head 22 and the second actuator head 32. A second spring 43 is provided between the second actuator head 32 and the printhead 232. In one embodiment, the second spring 43 bears against a thrust washer 45 that is seated concentrically about the central opening 240 in the printhead. In one specific embodiment the thrust washer may reside within a recess 241, as illustrated in FIG. 4.

When the first stage actuator 20 is rotated, the actuator shaft 25 advances distally due to operation of the cam mechanism 14, as described above. This causes the head 22 to translate toward the printhead, thereby compressing the first spring 41 between the first and second heads 22, 32. Compressing the spring generates a spring force that acts to push against the head 32 of the second actuator. This force applied to the second head 32 is transmitted through the second spring 43 to the thrust washer 45 and ultimately to the printhead 232. Thus, as the first stage actuator is rotated a first clamping force is applied to the printhead to at least advance the printhead toward the carriage plate assembly 260.

In a similar manner, rotation of the second stage actuator 30 advances the head 32 toward the printhead, thereby compressing the second spring 43 between the actuator head and thrust washer 45. This compression causes the spring 43 to generate a spring force, which is applied to the printhead to press it farther into engagement with the surface 264 of the plate assembly 260. It can be appreciated that the force transmitted by movement of the second stage actuator 30 is independent of the first stage actuator 20, but the force transmitted by movement of the first stage actuator 20 requires involvement of the second stage actuator and the second spring.

Figure 1:
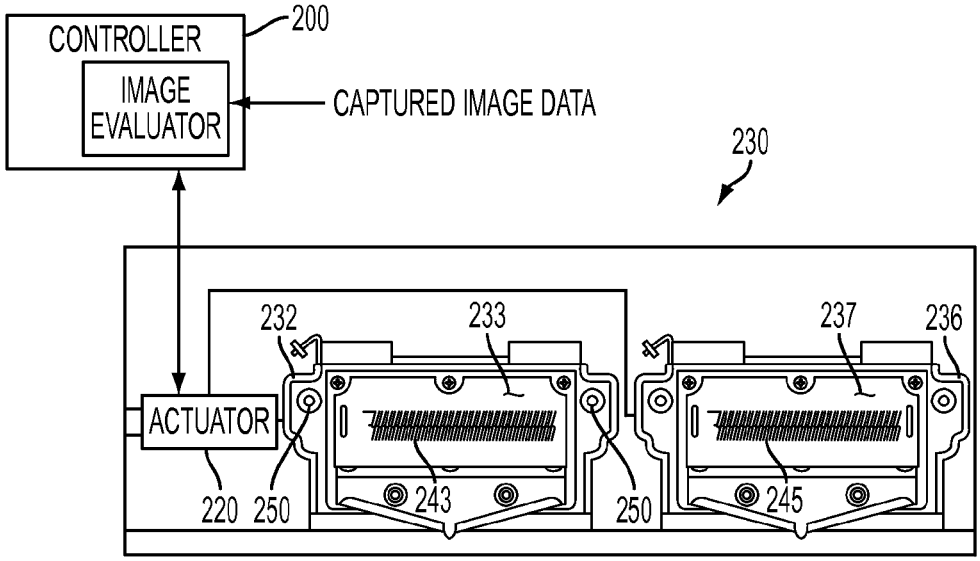
FIG. 1 is a diagram of a printhead assembly having two printheads.
Figure 2:
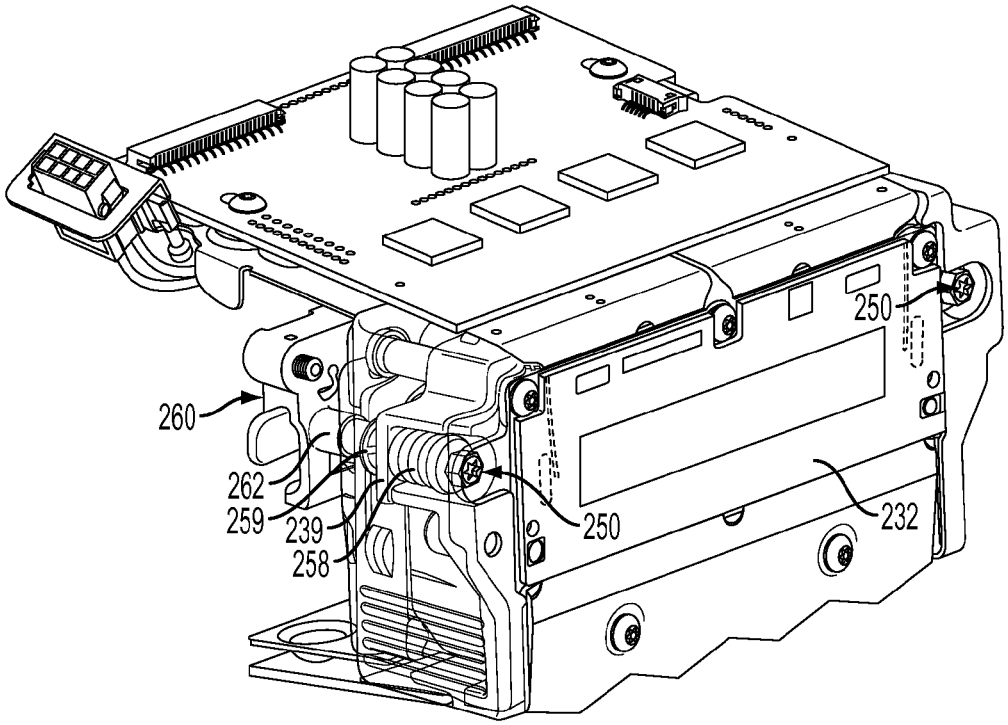
FIG. 2 PRIOR ART
FIG. 2 is a perspective view of a printhead mounted to a carriage plate assembly using a latching assembly of the prior art.
Figure 3:
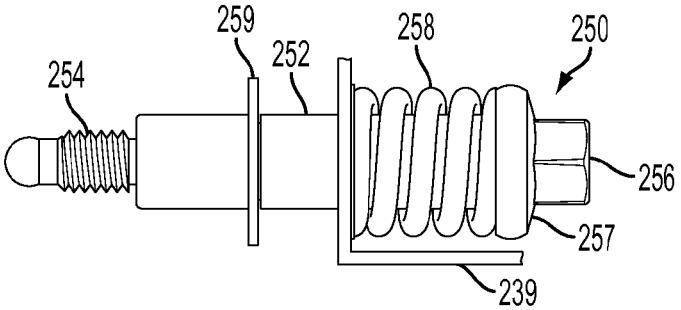
FIG. 3 PRIOR ART
FIG. 3 is an enlarged side view of a latching assembly of the prior art used to mount the printhead shown in FIG. 2

The latch assembly 10 contemplates two stage operation with a first stage providing a low force engagement between the printhead and the plate assembly to help seat the parts for proper alignment. Thus, in one aspect of the illustrated embodiment, the first spring 41 has a relatively lower spring constant than the second spring 43. Moreover, the amount of axial travel of the first state actuator 20 is calibrated to compress the first spring by a predetermined amount to generate a predetermined initial clamping force that achieves this seating and alignment function. This initial clamping force is sufficient to hold the printhead in close proximity to the plate assembly while permitting the operator to manipulate or wiggle the printhead to ensure proper seating relative to the surface 264 of the plate assembly. It can be appreciated that this predetermined amount of force can be automatically provided by simply rotating the first stage actuator 20 to its fullest extent—i.e., until the cam followers 60*a*, 60*b* are seated within the respective retention end 29*b* of the first stage cam tracks 28*a*, 28*b*. This ease of use is in contrast to the prior art latching mechanism shown in FIG. 2 that required the operator to guess at a proper initial rotation. Moreover, the use of the cam mechanism 14 enhances the mechanical advantage provided by rotating the first stage actuator so that only a quarter turn of the actuator is required to provide the initial clamping force, in contrast to the multiple turns required with the prior art latching mechanism.

Figure 6:
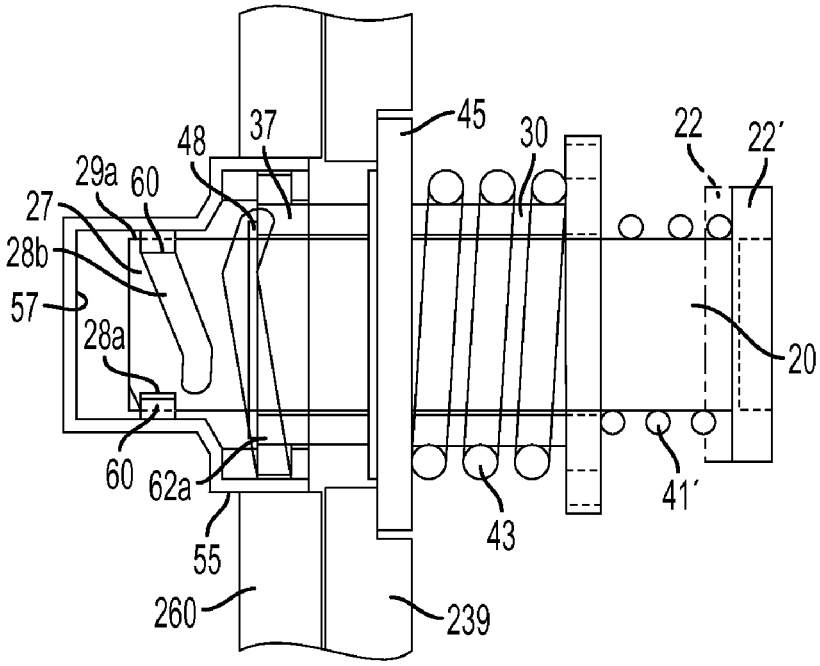
FIG. 6 is a side view of the latching assembly of FIG. 5 with the assembly in an initial orientation.

The initial position of the actuator assembly 12 and cam mechanism 14 is depicted in FIG. 6. In this configuration the springs 41 and 43 are in their free state or only slightly compressed. In order to hold the latch assembly 10 together, particularly when the springs are slightly compressed, a pair of retainers is provided. A first retainer 48 is engaged to the first shaft 25 adjacent the cam end 27 and is sized to prevent passage through the central bore 36 in the second actuator shaft 35. A second retainer 49 is engaged to the second shaft 35 on the distal side of the thrust washer 45 so that the thrust washer and spring 43 are trapped between the second actuator head 32 and the second retainer 49. The latch assembly 10 thus presents a complete assembly that can be easily mounted within the coaxial openings 240, 241 with the thrust washer 45 seated on the printhead. As the latch assembly is advanced through the coaxial openings, the cam ends 27, 37 enter the cam receptacle 55. A slight manipulation of the latch assembly aligns the cam features of the first and second actuators with the mating cam features of the cam receptacle so that the latching mechanism 10 is in the configuration shown in FIG. 6.

The initial rotation of the first stage actuator 20 moves the latching assembly to the configuration shown in FIG. 4. In this configuration, the first stage head is advanced from the position 22' shown in FIG. 6 to the intermediate position 22 shown in FIG. 4. Likewise, the cam end 27 of the first stage actuator advances into the cavity 57 of the cam receptacle 55. As explained above, the first stage actuator is rotated until the cam followers 60*a*, 60*b* are seated within the retention ends 29*b*. The first spring is thus compressed from its initial position 41' shown in FIG. 6 to its position shown in FIG. 4 in which it applies a clamping force to the printhead through the second actuator head and second spring, as explained above.

Figure 7:
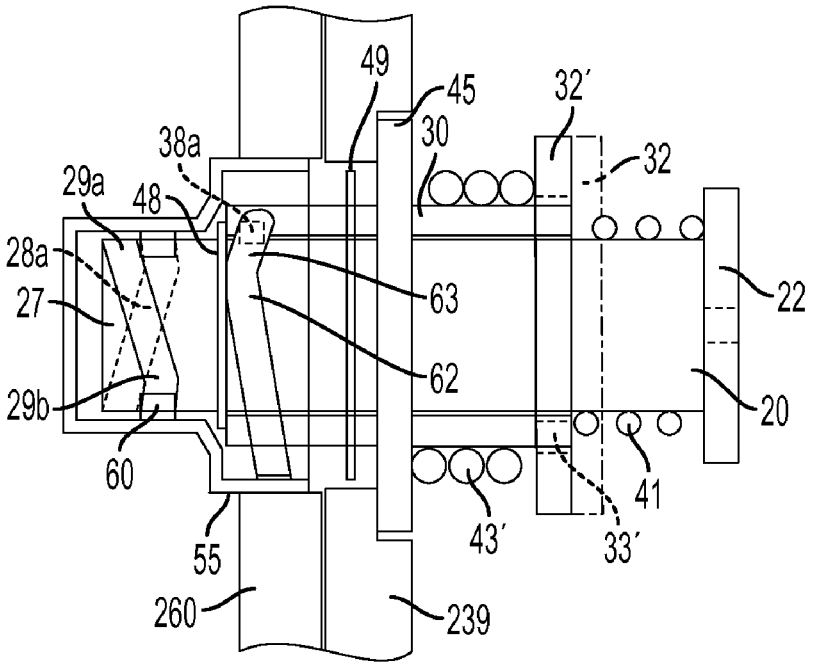
FIG. 7 is a side view of the latching assembly of FIG. 5 with the assembly in a final orientation clamping the printhead to the carriage plate assembly.

Once the operator has verified that the printhead is properly aligned and seated, the final tightening can be achieved by rotating the second stage actuator 30. As shown in FIG. 7, rotation of the second actuator advances the actuator head from the position 32 shown in FIG. 4 to the position 32' in FIG. 7. This axial movement compresses the second spring from its initial state 43 to the compressed state 43'. This compression produces a spring force that bears against the thrust washer 45 to firmly clamp the printhead 232 against the carriage plate assembly 260. It can be appreciated that in this final latching position the first spring 41 expands as the second actuator head 32 moves axially away from the first actuator head 22. However, in this final clamping stage the first stage actuator is not necessary to complete the final latching operation. because the second actuator shaft is free to translate relative to the first actuator shaft passing through the central bore 36.

Figure 5:
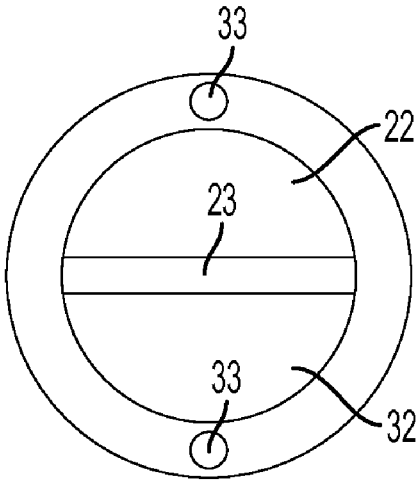
FIG. 5 is an end view of the latching assembly shown in FIG. 4.
Figure 8:
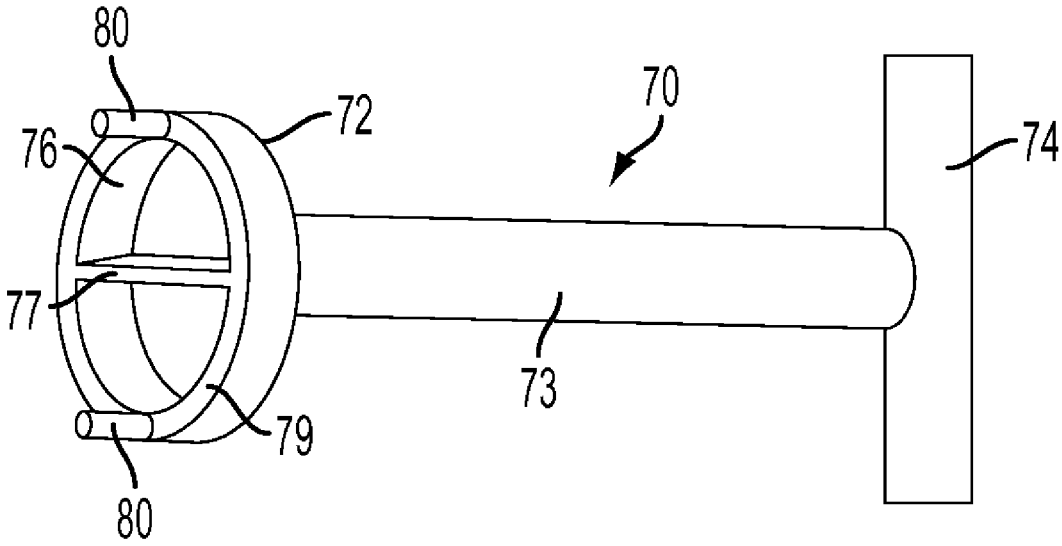
FIG. 8 is a perspective view of a tool for engagement with the latching assembly shown in FIGS. 4-5, with the latching assembly in an intermediate position.

In a further feature, a tool 70 is provided for rotating the first and second stage actuators. The tool engagement features and tool are configured to prevent actuation of the second stage until the first stage has been actuated. Thus, as shown in FIG. 5, the tool engagement feature 23 for the head 22 of the first stage actuator 20 is inboard of the tool engagement feature 33 for the head 32 of the second stage actuator 30. In one embodiment, the first tool engagement feature 23 is a slot for receiving a screwdriver-type tool, which the second tool engagement feature 33 is a pair of bores formed in the head 32. The tool 70, shown in FIG. 8, includes a head 72 with a shaft 73 connected to a handle 74 to facilitate manual rotation of the tool. The head 72 defines a cavity 76 that is sized to fit over the head 22 of the first stage actuator. A driving member 77 is disposed within the cavity 76 and is configured for mating engagement with the tool engaging feature 23 of the first stage head. Thus, in the illustrated embodiment, the driving member 77 is a plate similar to a flat head screwdriver, although other driving member and tool engagement features are contemplated.

The tool 70 further includes a rim 79 that defines the cavity 76 and that is sized to contact the head 32 of the second stage actuator around the first stage head. The rim 79 defines a pair of driving elements 80 projecting therefrom. The tool engagement features 33 may thus constitute a pair of bores configured to receive the driving elements 80. It is of course understood that the engagement features and driving elements for both actuators may be reversed so that, for instance, the actuator head 32 includes a pair of posts while the tool 70 includes a pair of bores.

The head 72 of the tool 70 is configured so that the driving elements 80 cannot engage the tool engaging features 33 of the second stage head 32 until the first stage head 22 has been advanced. Thus, the operator initially engages the tool 70 to the first actuator head 22, with the driving feature 77 mating with the tool engaging feature 23. The tool is used to rotate the first stage actuator 20 to move the actuator from the initial position of FIG. 6 to the position shown in FIG. 4. In this configuration the first actuator head is close enough to the second actuator head for the second driving elements 80 to mate with the tool engaging feature 33 of the second stage actuator 30. The tool can then be used to rotate the second stage actuator from the position shown in FIG. 4 to the final latching position shown in FIG. 7.

As shown in FIG. 5, the tool engaging features between the two actuators are offset by 90°. This offset is required because the first stage actuator is rotated before the tool is allowed to engage the second stage actuator. In the illustrated embodiment the cam mechanism 14 is configured to provide a quarter turn or 90° rotation for each stage actuator. It is contemplated that some mechanism is provided to isolate the action of the two driving features 77 and 80. In other words, the tool 70 may be configured so that the driving feature 80 can rotate the second stage actuator head 32 independent of or without also rotating the first stage actuator head 22, which has already been rotated by the first driving feature 77. This independent movement may be accomplished by incorporating a slip clutch or ratchet wrench type feature between the two driving features 77, 80, or modifying the shaft 73 of the tool 70 so that it progressively actuates each of the driving features. As a further alternative, the first driving feature 77 may be telescopingly disposed within the second driving feature 80 so that it can be retracted when it is necessary to use the second driving feature. It may be further contemplated that in lieu of modifying the tool the cam track 28 for the first stage can be modified to permit additional rotation of the first stage actuator 20 without imparting further longitudinal movement of the actuator.

Alternatively, the tool 70 may incorporate the driving member 77 into the working end of a telescoping element that can be extended from the other driving member 80. In a further alternative, two different tools may be utilized to engage each respective tool engagement feature.

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the claims that follow.

What is claimed is:

1. A latching assembly for mounting a printhead to a plate assembly of a printing machine, the printhead and the plate assembly having coaxial openings, said latching assembly comprising:

a first elongated actuator having a first head end and an opposite first cam end;

a second elongated actuator configured to extend through the coaxial openings in the printhead and the plate assembly, said second actuator having a second head end and an opposite second cam end, and defining a bore configured to slidably receive said first elongated actuator therethrough;

a first force transmission element disposed between said first head end and said second head end;

a second force transmission element disposed between said second head end and the printhead;

a cam mechanism defined between the plate assembly and said first cam end and said second cam end, said cam mechanism configured to draw said first head end toward the plate assembly upon rotation of said first cam end and to draw said second head end toward the plate assembly upon rotation of said second cam end, wherein movement of said first head end toward the plate assembly causes the first force transmission element to exert a force on said second head end and movement of said second head end toward the plate assembly causes the second force transmission element to exert a force on the printhead.

2. The latching assembly of claim 1, wherein said cam mechanism is configured to limit rotation of said first and second cam ends to less than 360 degrees.

3. The latching assembly of claim 2, wherein said cam mechanism is configured to limit rotation of said first and second cam ends to about 90 degrees.

4. The latching assembly of claim 1, wherein said first force transmission element is configured to transmit less force than said second force transmission element for the same amount of movement of the respective first and second head ends.

5. The latching assembly of claim 1, wherein:

said first force transmission element is a coil spring mounted coaxially about said first elongated actuator; and said second force transmission element is a coil spring mounted coaxially about said second elongated actuator.

6. The latching assembly of claim 1, wherein said cam mechanism includes:

a receptacle mounted to the plate assembly, said receptacle defining a cavity in communication with the coaxial openings to receive said first and second cam ends, said receptacle including a side wall at said cavity;

a first cam track and follower arrangement defined between said side wall and said first cam end; and a second cam track and follower arrangement defined between said side wall and said second cam end.

7. The latching assembly of claim 6, wherein:

said first elongated actuator has a length greater than the length of said second elongated actuator; and said second cam track and follower arrangement is disposed between said first cam track and follower arrangement and the printhead.

8. The latching assembly of claim 6, wherein said first cam track and follower arrangement includes a cam track defined in said first cam end and a follower projecting radially inward from said side wall of said receptacle.

9. The latching assembly of claim 6, wherein said second cam track and follower arrangement includes a cam track defined in said side wall of said receptacle and a follower projecting radially outward from said second cam end.

10. The latching assembly of claim 1, wherein:

said first head end includes a first tool engagement feature configured to be engaged by a driving tool; and said second head end includes a second tool engagement feature different from said first tool engagement feature.

11. The latching assembly of claim 10, wherein said first force transmission element is configured to prevent engagement of said second tool engagement feature until said first head end has moved toward said second head end.

* * * * *